US006466521B1

(12) United States Patent
Mitaki

(10) Patent No.: US 6,466,521 B1
(45) Date of Patent: Oct. 15, 2002

(54) SENSOR FUNCTION-EQUIPPED PORTABLE DEVICE

(75) Inventor: Kazuya Mitaki, Tachikawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 08/535,043

(22) PCT Filed: Feb. 10, 1995

(86) PCT No.: PCT/JP95/00185

§ 371 (c)(1),
(2), (4) Date: Oct. 13, 1995

(87) PCT Pub. No.: WO95/23358

PCT Pub. Date: Aug. 31, 1995

(30) Foreign Application Priority Data

Feb. 25, 1994 (JP) ..... 6-028036

(51) Int. Cl.[7] ..... G04B 1/00
(52) U.S. Cl. ..... 368/204
(58) Field of Search ..... 368/204, 203

(56) References Cited

U.S. PATENT DOCUMENTS

| | | | | |
|---|---|---|---|---|
| 4,290,100 A | * | 9/1981 | Squires | 368/204 |
| 4,404,624 A | * | 9/1983 | Yamazaki | 368/204 |
| 4,529,322 A | * | 7/1985 | Ueda | 368/255 |
| 4,879,669 A | * | 11/1989 | Kihara et al. | 368/11 |
| 5,283,474 A | * | 2/1994 | Oi et al. | 307/116 |
| 5,359,891 A | * | 11/1994 | Yamamoto et al. | 73/204.15 |

FOREIGN PATENT DOCUMENTS

| | | |
|---|---|---|
| JP | 53-3864 | 1/1978 |
| JP | 56-125683 | 10/1981 |
| JP | 57-6384 | 1/1982 |
| JP | 57-12383 | 1/1982 |
| JP | 58-129195 | 9/1983 |
| JP | 1-259220 | 10/1989 |

* cited by examiner

*Primary Examiner*—Bernard Roskoski
(74) *Attorney, Agent, or Firm*—Thompson Coburn, LLP

(57) ABSTRACT

The present invention relates to a sensor function-equipped portable device having a sensor function for detecting and displaying physical information, and it is an object of the present invention to provide a sensor function-equipped portable device that can ensure high resolution of A/D conversion and high reproducibility with use of only a single compact and inexpensive 1.5 V button-type silver cell.

To achieve this object, the present invention comprises a sensor function-equipped portable device which is furnished with a cell as a low-voltage power source and a step-up power source circuit that elevates the low voltage of this cell to a high voltage, and in which the sensor drive circuit is directly driven by the low voltage of this cell and the amplifier circuit and the A/D converter circuit are driven by the high voltage elevated by the step-up power source circuit.

The present invention makes it possible to perform sensor signal processing using a −1.5 V button-type silver cell through the provision of a step-up power source circuit, without sacrificing conentional performance, and thus makes it possible to produce a compact sensor function-equipped portable device of reduced size, thereby greatly increasing design freedom and reducing costs.

17 Claims, 8 Drawing Sheets

SENSOR FUNCTION-EQUIPPED PORTABLE DEVICE

TECHNICAL FIELD

The present invention relates to a sensor function-equipped portable device for detecting physical information, such as water depth and altitude, and displaying such information or issuing a warning.

BACKGROUND ART

Although sensor function-equipped portable devices having a single function, such as dive computers, altimeters, and depth gauges, have been used in, for example, marine sports and mountaineering, sensor function-equipped electronic clocks have recently been manufactured that, in addition to their ordinary functions, e.g., basic time display function, alarm function, and timer function, also have sensor functions that use sensors to measure constantly changing physical information such as air pressure, water pressure, and temperature, and that display this information via a signal processor circuit; this kind of electronic clock has become more common.

With these sensor function-equipped portable devices, it is necessary to convert the physical information obtained as analog values into digital values in order to display the physical information detected by the sensors in a digital fashion; a 3 V high voltage power source means, for example, is required for this A/D conversion; in the past, a 3 V coin-type lithium cell has been used, or two or three 1.5 V button-type silver cells have been used.

However, a coin-type lithium cell or two or three button-type silver cells result in a bulky clock element, which increases costs, so that for portable devices such as electronic clocks that have limited electronic circuit housing space and that must be inexpensive, operation with a single 1.5 V button-type silver cell is desired.

Prior art is described below with reference to accompanying drawing.

FIG. 2 is a block diagram of a conventional sensor signal processor used in a sensor-equipped portable device.

In FIG. 2, 101 is an air pressure sensor adapted to output an air pressure signal S1 proportional to an air pressure P, 102 is a sensor drive circuit adapted to drive the air pressure sensor 101 by causing constant current to flow in the air preasure sensor 101, 103 is an amplifier circuit that amplifies the air pressure signal S1 using an operational amplifier not shown in the figure, and that outputs the result as a signal S1', 104 is an A/D converter circuit that subjects the signal S1' output from the amplifier circuit 103 to A/D conversion and outputs the resulting product as data Dc, 105 is a sensor information data processor circuit that processes the data Dc and outputs the result as sensor information data Dj, 106 is a display unit that digitally displays the air pressure value on the basis of the sensor information data Dj output from the sensor information data processor circuit 105, 107 is a constant-voltage power source circuit that generates a −2.6 V power source voltage Vreg, and 109 is a coin-type lithium cell that generates a −3.0 V power source voltage Vss.

FIG. 7 is a diagram depicting the internal structure of the sensor drive circuit 102.

The sensor drive circuit 102 comprises a resistor 102*a* with a resistance value Rs and an operational amplifier 102*b* whose power source is a −3.0 V power source voltage Vss. The negative input terminal of the operational amplifier 102*b* has the same potential Vs as the positive input terminal due to imaginary shortening with the air pressure sensor 101 as feedback resistance. A constant current Is, expressed by Formula (1) consequently flows in the resistor 102*a*, and the air pressure sensor 101 is thereby driven by the constant current Is.

$$Is=Vs/Rs \tag{1}$$

FIG. 9 is a diagram depicting the internal structure of the constant-voltage power source circuit 107.

The constant-voltage power source circuit 107 comprises a constant-voltage generator 171 and a basic reference voltage generator 107*a l composed of a resistor RO and a constant-current circuit 173. The constant-current circuit 173 allows a constant current Ir to flow through the resistor RO, so that a reference voltage Vr is generated due to the voltage drop across the resistor R0, and the reference voltage Vr is applied to the constant-voltage generator 171. The constant-voltage generator 171 subjects the reference voltage Vr to voltage/current amplification, and the resulting* −2.6 V power source voltage Vreg is supplied to the amplifier circuit 103 and the A/D converter circuit 104.

A conventional sensor signal processor having the aforementioned circuit structure operates as described below.

A voltage Vss of a coin-type lithium cell 109 serves as the power source, and when the air pressure sensor 101 is subjected to constant-current driving by the sensor drive circuit 102, an air pressure signal S1 proportional to the air pressure P applied to the air pressure sensor 101 is output. As shown in FIG. 10, the air pressure signal S1 is amplified by the amplifier circuit 103, with a voltage of Vreg/2 that is half of the power source voltage Vreg that serves as the reference, resulting in a signal S1'. As far as this amplified signal S1' is concerned, the difference between the voltage Vreg/2 and the signal S1' is subjected to digital conversion by the A/D converter circuit 104, with the voltage Vreg/2 serving as the reference, to produce digital data Dc. The digital data Dc is converted into a sensor information signal Dj by the sensor information processor circuit 105, and the display unit 106 displays the air pressure value (e.g., 1013 hPa) based on this sensor information signal Dj. The signal S1' that has been amplified by the amplifier circuit 103 varies within a range between the voltage Vreg/2 and the voltage Vreg shown in FIG. 10, the potential difference between Vreg and Vreg/2 is taken as the dynamic range, and, for a given air pressure range, the resolution of the A/D converter circuit 104 can be increased for a larger dynamic range, so that the air pressure value display resolution can be increased. Since the number of bits per unit display air pressure can be increased, it is also possible to reduce the variation in the air pressure value display that is caused by bit errors due to poor A/D conversion reproducibility.

As described above, when display resolution and bit errors during A/D conversion are taken into account, it is sometimes necessary to increase the dynamic range of the signal S1' amplified by the amplifier circuit 103. For this reason, the power source voltage Vreg must be about −2.6 V to generate such a Vreg, and the constant-voltage power source circuit 107 must have a power source voltage Vss that is −3.0 V or less, and the cell 109 must be of a voltage of 3 V or more.

To maintain a power source voltage of 3 V or more, however, either a coin-type lithium cell with a large diameter or a plurality of 1.5 V button-type silver cells must be used; as far as portable devices such as electronic clocks with limited electronic circuit element housing space are concerned, the size of the module becomes considerable, and this is disadvantageous in terms of design and cost.

The present invention was devised in light of the aforementioned situation, and its objective is to provide a sensor function-equipped portable device that can maintain A/D conversion resolution and reproducibility using only a single small and inexpensive 1.5 V button-type silver cell.

DISCLOSURE OF THE INVENTION

To achieve this objective, the present invention provides a sensor function-equipped portable device comprising a sensor for detecting physical information, a sensor drive circuit for driving the sensor, an amplifier circuit for amplifying the sensor signal from the sensor, an A/D converter circuit for converting the output signal of the amplifier circuit into digital information, a sensor information data processor circuit for preparing sensor information data from the digital information output from the A/D converter circuit, and a display unit for displaying physical values based on the sensor information data from the sensor information data processor circuit, wherein a low voltage power source cell and a step-up power source circuit for elevating the low voltage of the cell to a high voltage are furnished, and the sensor drive circuit is directly driven by the low voltage of the cell, and the amplifier circuit and the A/D converter circuit are driven by the high voltage that has been elevated by the step-up power source circuit.

The sensor function-equipped portable device according to the present invention further comprises a constant-voltage power source circuit for stabilizing the high voltage that is elevated by the step-up power source circuit, and in which the amplifier circuit and the A/D converter circuit are driven by the high voltage that has been stabilized by the constant-voltage power source circuit.

BEST MODE FOR CARRYING OUT THE INVENTION

Embodiments of the present invention are described in detail below by reference to drawings.

Figure 1:
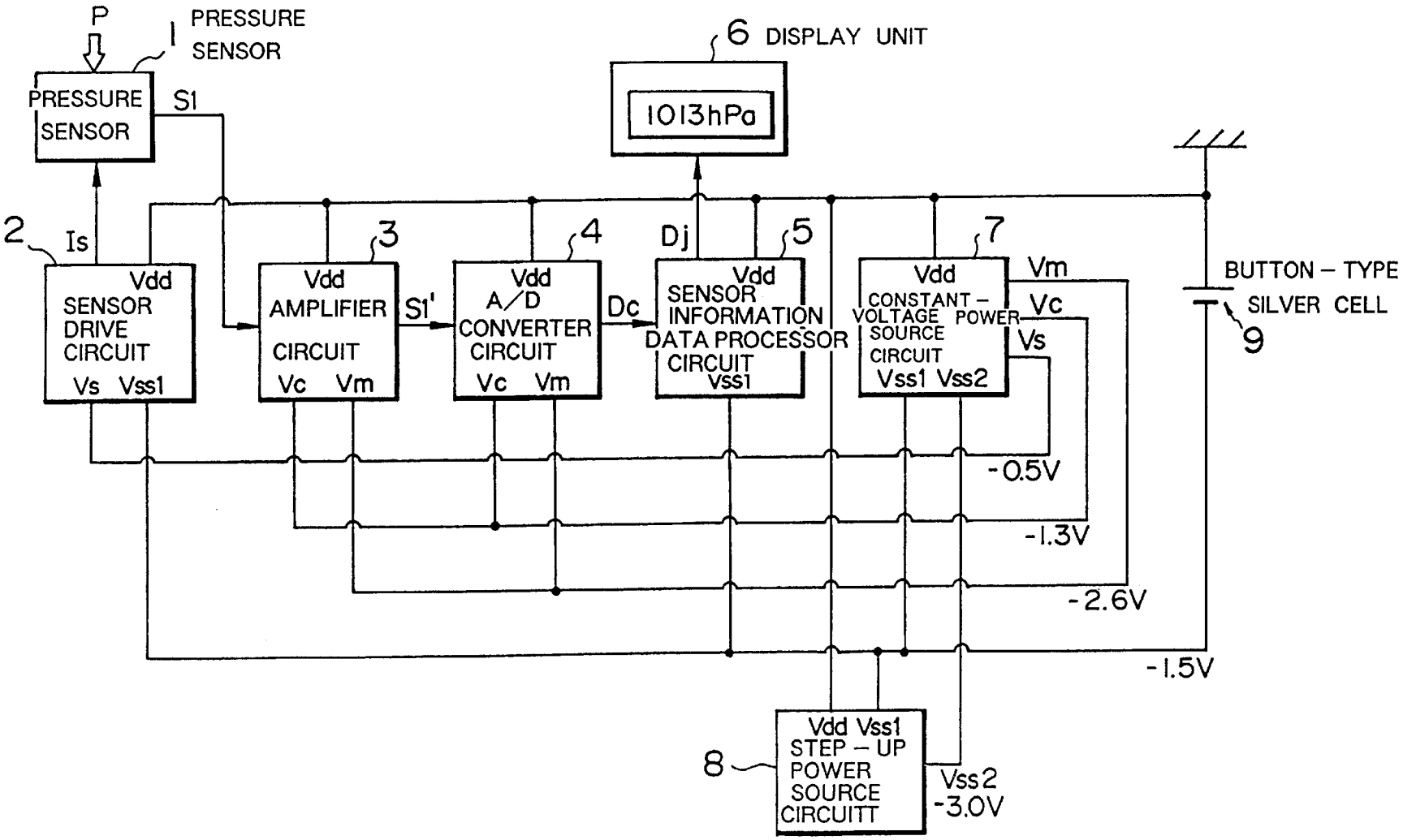
FIG. 1 is a block diagram of the sensor signal processor used in one embodiment of the sensor function-equipped portable device according to the present invention.
Figure 2:
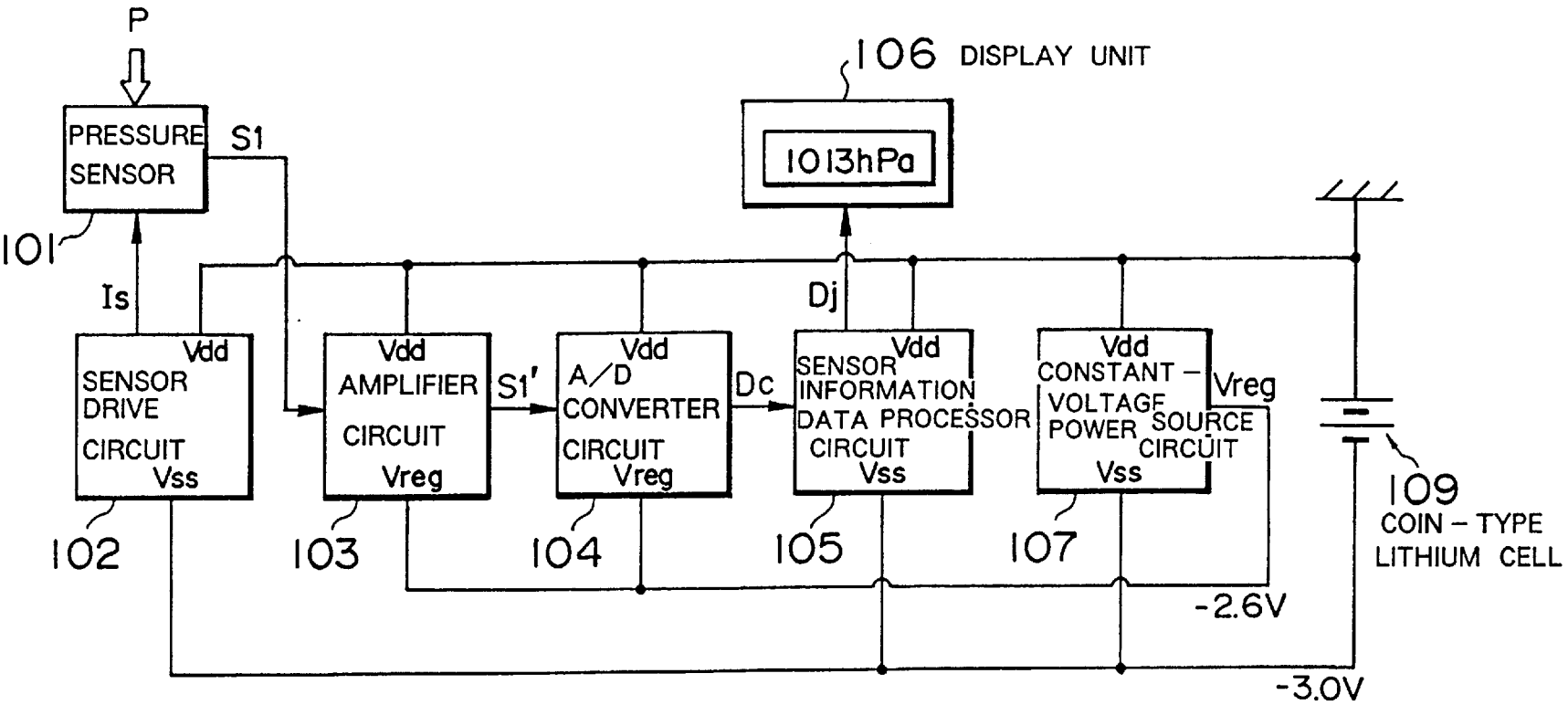
FIG. 2 is a block diagram of an example of a conventional sensor signal processor used in a sensor function-equipped portable device.

FIG. 1 depicts a block diagram of a sensor signal processor used in one embodiment of the sensor function-equipped portable device according to the present invention. The sensor function-equipped portable device shown here is designed to display atmospheric pressure.

Referring to FIG. 1, 1 is an air pressure sensor for outputting an air pressure signal S1 proportional to the air pressure P, 2 is a sensor drive circuit for driving the air pressure sensor 1 by allowing a constant current to flow therethrough, 3 is an amplifier circuit for amplifying the air pressure signal S1 using an operational amplifier not shown in the drawing and outputting a signal S1', 4 is an A/D converter circuit for subjecting the signal S1' output from the amplifier circuit 3 to A/D conversion and outputting data Dc, 5 is a sensor information data processor circuit for processing the converted data Dc, converting it into sensor information data Dj, and outputting this data Dj, 6 is a display unit for the digital display of the air pressure value based on the sensor information data Dj output from the sensor information data processor circuit 5, 7 is a constant-voltage power source circuit for generating a −0.5 V sensor reference voltage Vs, a −1.3 V measurement reference voltage Vc, and a −2.6 V stable power source voltage Vm, 8 is a step-up power source circuit for doubling the −1.5 V cell voltage Vss1 and generating a −3.0 V elevated voltage Vss2, and 9 is a button-type silver cell for generating the −1.5 V cell voltage Vss1.

Figure 3:
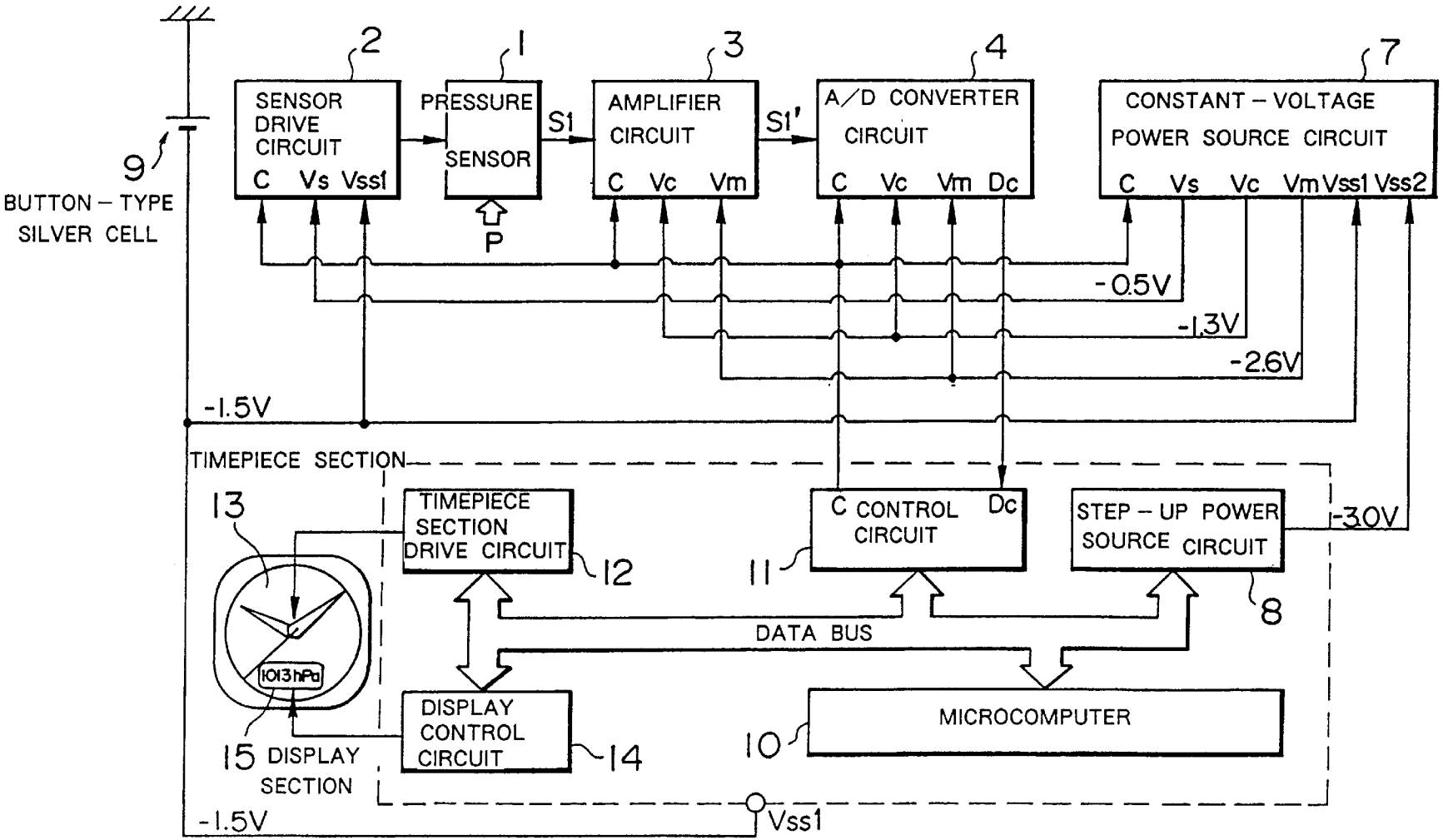
FIG. 3 is a block diagram of a sensor function-equipped electronic timepiece to which the sensor signal processor shown in FIG. 1 is applied.

Meanwhile, FIG. 3 is a block diagram of a sensor function-equipped electronic timepiece to which the sensor signal processor shown in FIG. 1 is applied, wherein the same reference numbers are given to the same structural elements, and an explanation is therefore omitted.

10 is a microcomputer for controlling the operation of the entire sensor function-equipped electronic timepiece unit, and 11 is a control circuit which receives data Dc from A/D converter circuit 4 and outputs a control signal C for controlling the sensor drive circuit 2, the amplifier circuit 3, the A/D converter circuit 4, and the constant-voltage power source circuit 7, on the basis of instructions from the microcomputer 10. The control circuit 11 outputs data Dc to the microcomputer 10 via a data bus, and the microcomputer 10 processes the data Dc and converts it into sensor information data and outputs it to the data bus. 12 is a timepiece drive circuit that is controlled by the microcomputer 10 and that drives a timepiece section 13. 13 is a timepiece section for displaying the time and other things, 14 is a display control circuit for effecting control so that the sensor information data on the data bus output from the microcomputer is displayed, and 15 is a display section that is controlled by the display control circuit 14 and that digitally displays the air pressure value. With this structure, the control circuit 11, the microcomputer 10 and the display control circuit 14 correspond to the sensor information data processor circuit shown in FIG. 1. The aforementioned button-type silver cell 9 is also used as a power source for each of the controllers of the timepiece section 13.

Figure 4:
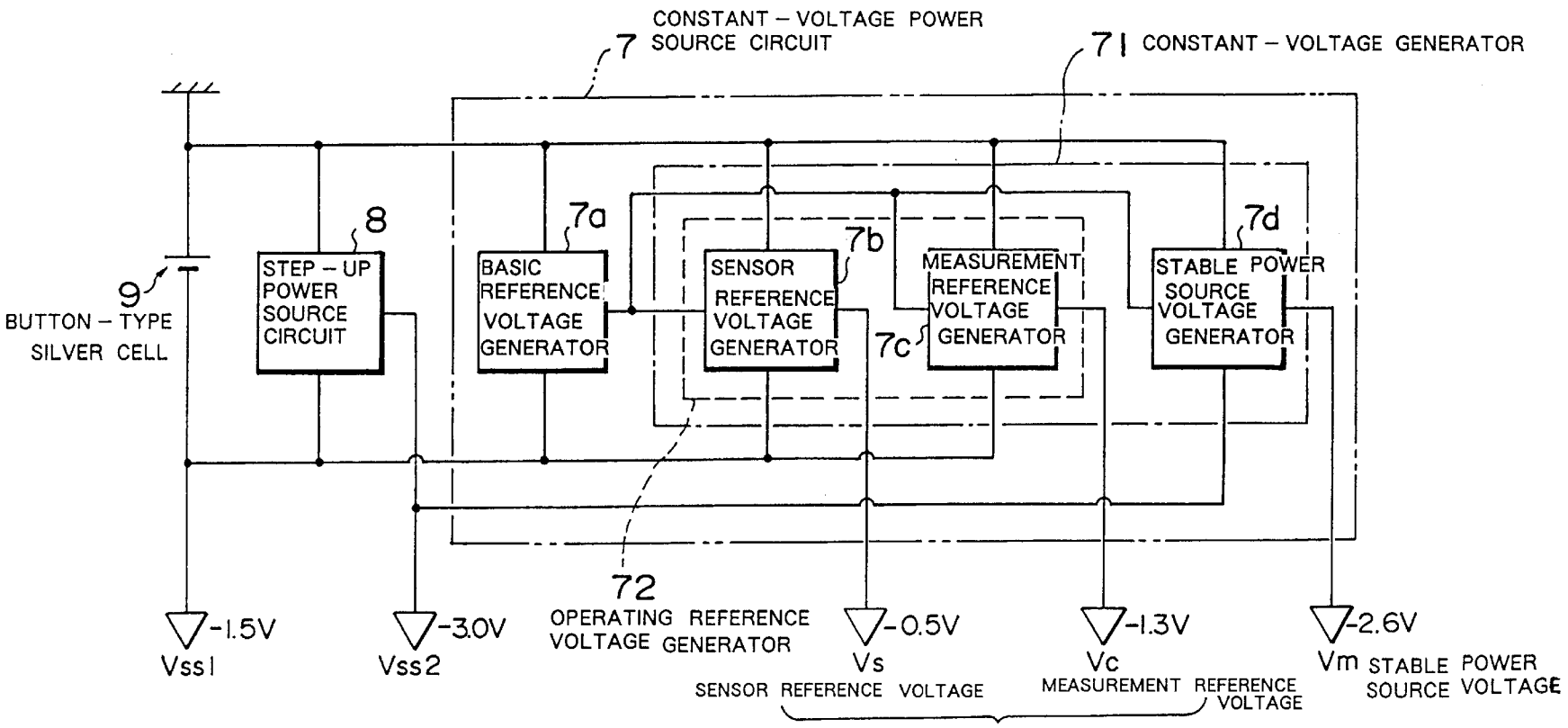
FIG. 4 is a block diagram depicting the internal structure of the constant-voltage power source circuit shown in FIGS. 1 and 3.

FIG. 4 is a block diagram which depicts the internal structure of the constant-voltage power source circuit 7 shown in FIGS. 1 and 3.

The constant-voltage power source circuit 7 is composed of a basic reference voltage generator 7*a* and a constant-voltage generator 71. The constant-voltage generator 71 is composed of an operating reference voltage generator 72 and a stable power source voltage generator 7*d* for generating a stable power source voltage Vm. The operating reference voltage generator 72 is composed of a sensor reference voltage generator 7*b* for generating a sensor reference voltage Vs, and a measurement reference voltage generator 7*c* for generating a measurement reference voltage Vc. Both of the voltages generated by the operating reference voltage generator 72, i.e., the sensor reference voltage Vs and the measurement reference voltage Vc, are referred to as operating reference voltage.

Figure 5:
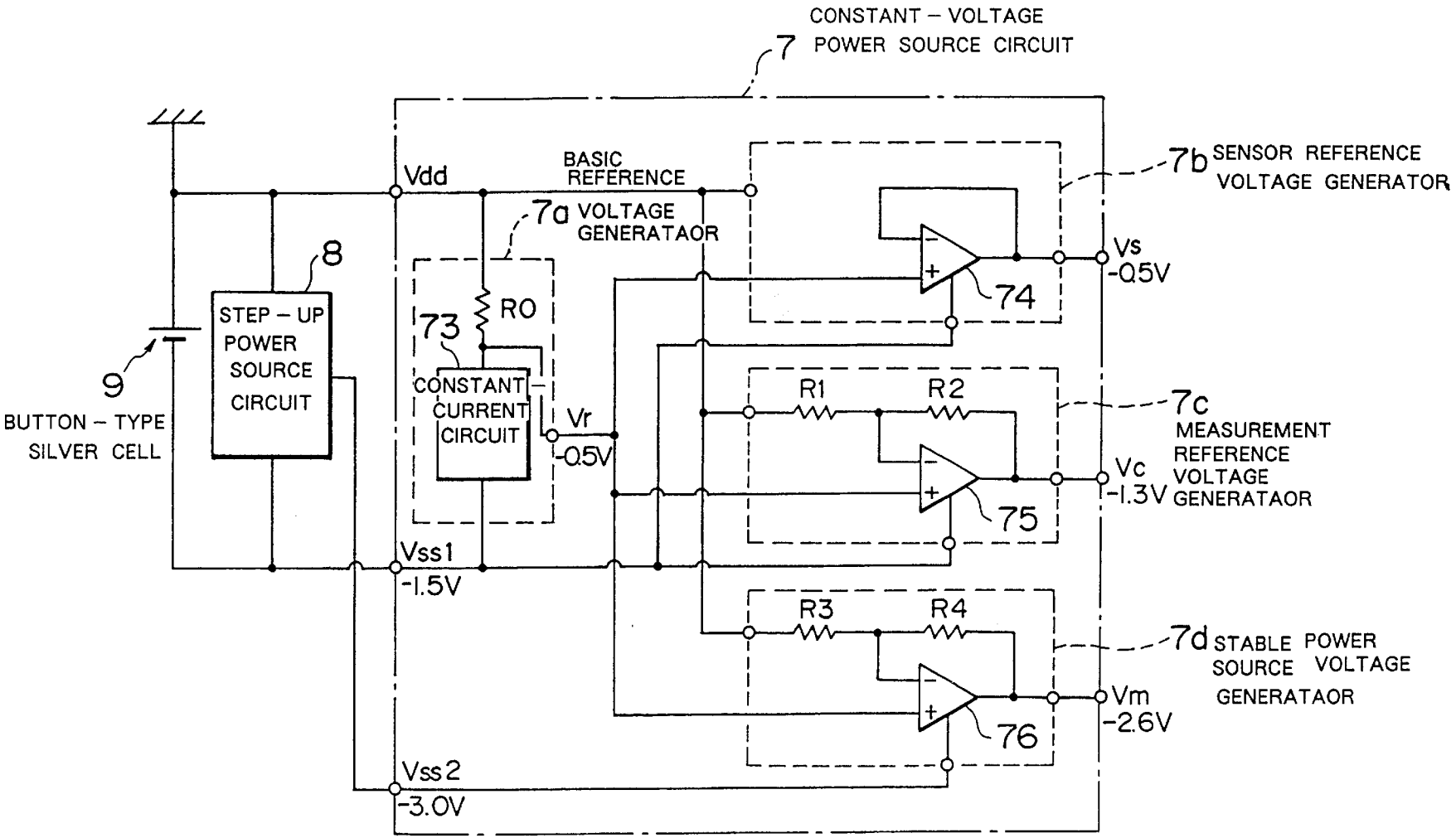
FIG. 5 is a circuit structural diagram of the constant-voltage power source circuit shown in FIG. 4.

FIG. 5 is a circuit diagram of the constant-voltage power source circuit 7 shown in FIG. 4.

The basic reference voltage generator 7*a* is composed of a resistor R0 and a constant-current circuit 73, the sensor reference voltage generator 7*b* is composed of an operational amplifier 74, the measurement reference voltage generator 7*c* is composed of resistors R1 and R2 and an operational amplifier 75, and the stable power source voltage generator 7*d* is composed of resistors R3 and R4 and an operational amplifier 76.

The basic reference voltage Vr from the basic reference voltage generator 7*a* is applied to the + input terminals of the operational amplifiers 74, 75, and 76, and the operational amplifiers 74 and 75 take the cell voltage Vss1 as their power source, and the operational amplifier 76 takes the elevated voltage Vss2 as its power source.

The ratio between the resistance values of the resistors R1 and R2 is set so that the measurement reference voltage Vc output from the operational amplifier 75 is 31 1.3 V, and the ratio between the resistance values of the resistors R3 and R4 is set so that the stable power source voltage Vm output from the operating amplifier 76 is −2.6 V.

Figure 6:
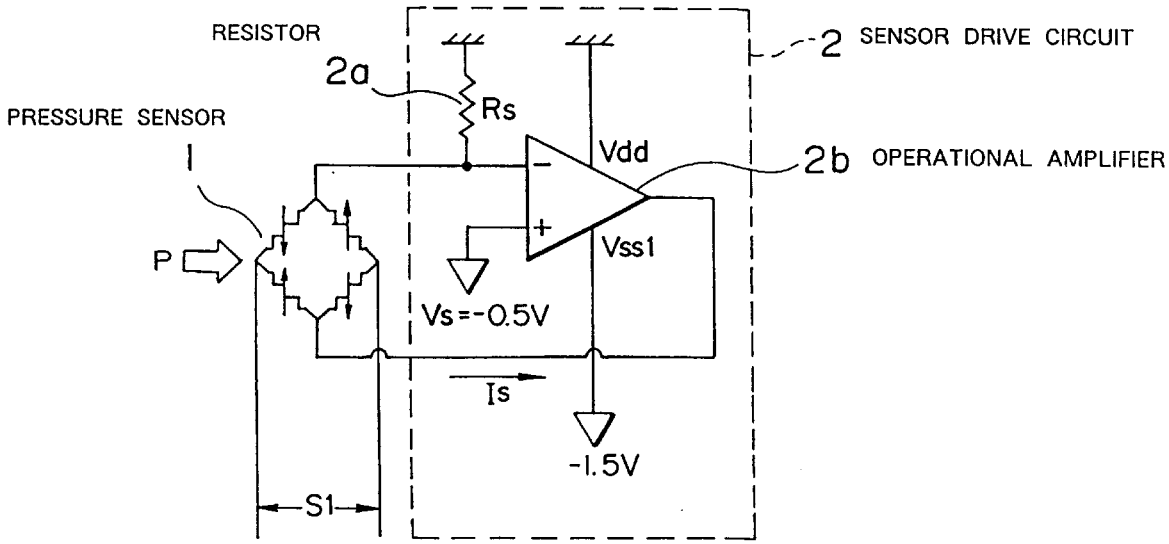
FIG. 6 is a diagram depicting the internal structure of the sensor drive circuit shown in FIGS. 1 and 3.
Figure 7:
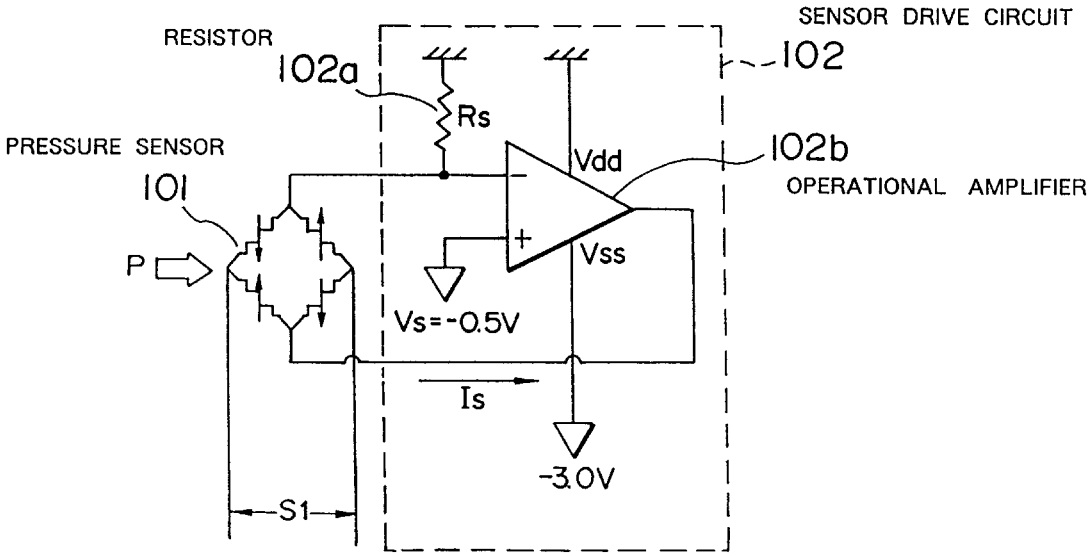
FIG. 7 is a diagram depicting the internal structure of the sensor drive circuit shown in FIG. 2.

FIG. 6 is a diagram of the internal structure of the sensor drive circuit 2 shown in FIGS. 1 and 3.

The sensor drive circuit 2 is composed of a resistor 2*a* having a resistance value Rs and an operational amplifier 2*b* that takes −1.5 V power source voltage Vss1 as its power source. The − input terminal of the operational amplifier 2*b* has the same potential as the sensor reference voltage Vs applied to the + input terminal due to imaginary shorting, with the air pressure sensor 1 as feedback resistance. A constant current Is is thus caused to flow in the resistor 2*a*, so that the air pressure sensor 1 is consequently driven by the constant current Is.

Figure 8:
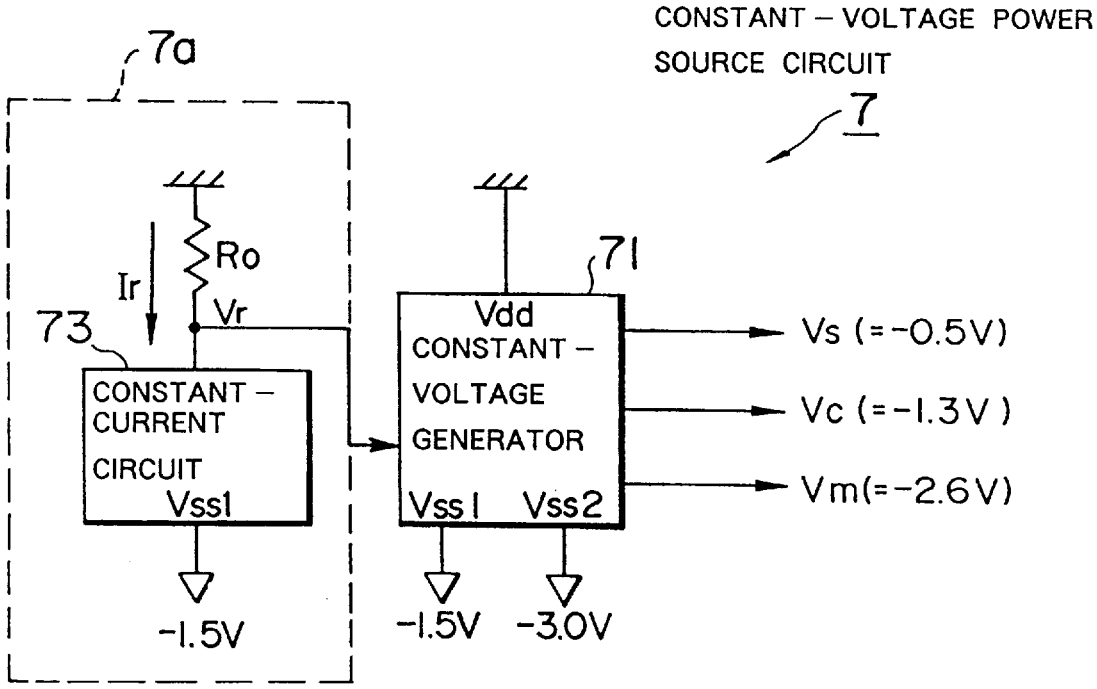
FIG. 8 is diagram depicting the internal structure of the constant-voltage power source circuit shown in FIGS. 1 and 3.
Figure 9:
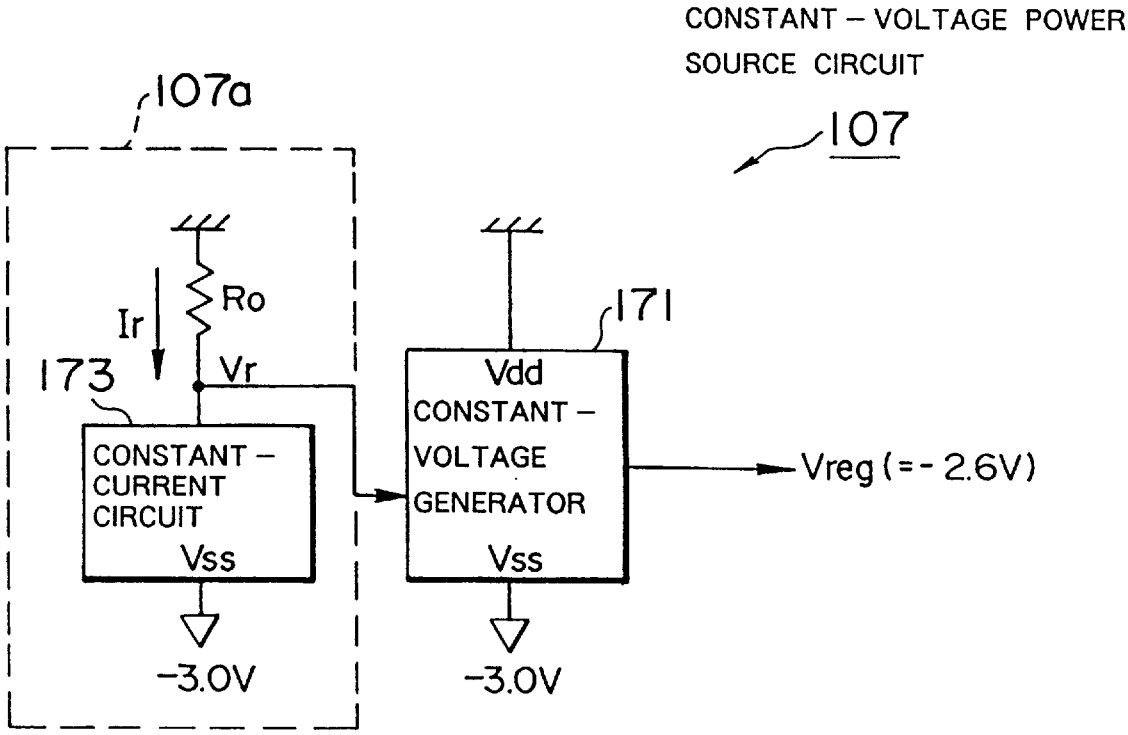
FIG. 9 is a diagram depicting the internal structure of a constant-voltage power source circuit.
Figure 10:
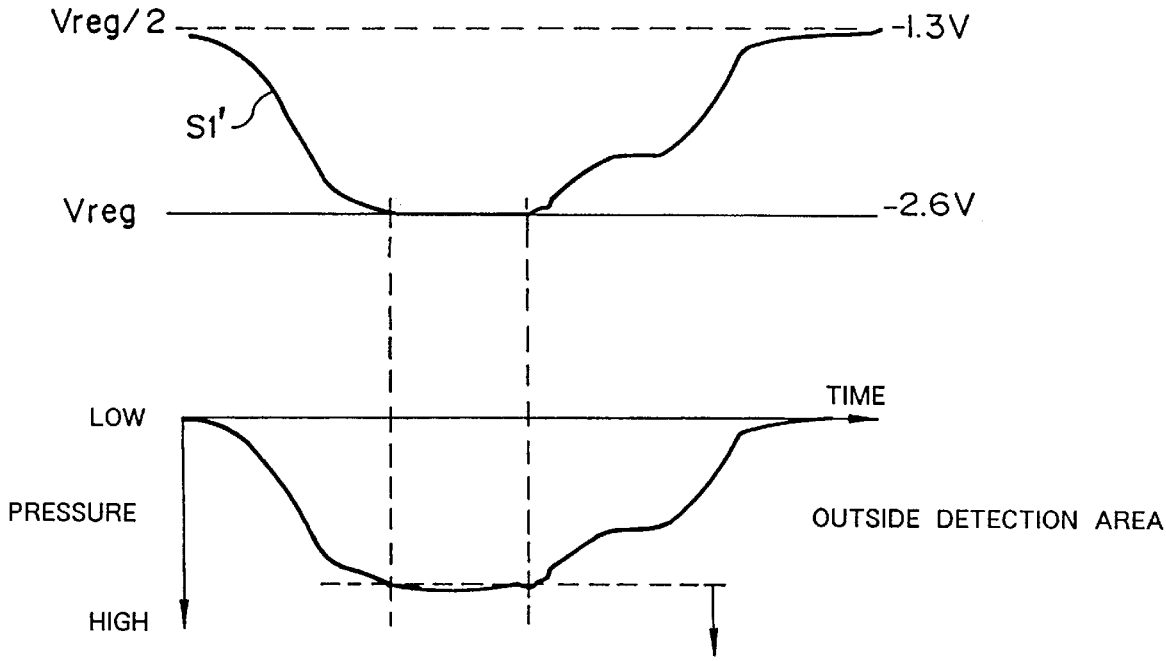
FIG. 10 is a diagram depicting the various potential relationships among the measurement systems.

FIG. 8 is a diagram of the internal structure of the constant-voltage power source circuit 7 shown in FIGS. 1 and 3.

As described by reference to FIGS. 4 and 5, the constant-voltage drive circuit 7 is composed of a constant-voltage generator 71 and a basic reference voltage generator 7*a* consisting of a resistor R0 and a constant-current circuit 73. The constant-current circuit 73 allows a constant current Ir to flow through the resistor R0, and the basic reference voltage Vr generated by the voltage drop is supplied to the constant-voltage generator 71. The constant-voltage generator 71 subjects the basic reference voltage Vr to voltage/current amplification, and supplies the −0.5 V sensor reference voltage Vs to the sensor drive circuit 2, the −1.3 V measurement reference voltage Vc to the amplifier circuit 3 and the A/D converter circuit 4, and the −2.6 V stable power source voltage Vm to the amplifier circuit 3 and the A/D converter circuit 4 in order to stabilize the measurement system even when the voltage of the button-type silver cell 9 varies due to load fluctuations or the like.

The operation of the sensor function-equipped portable device which pertains to the present invention and which has the aforementioned circuit structure is described below.

The constant-voltage power source circuit 7 which pertains to the present invention, as shown in FIG. 4, operates the basic reference voltage generator 7*a* by means of −1.5 V cell voltage. Vss1, and operates the stable power source voltage generator 7*d* of the constant-voltage generator 71 by means of the −3.0 V elevated voltage Vss2. The reason for this is that, although with the step-up power source circuit 8 the elevated voltage Vss2 is generated using a charge pump for performing switching by means of a transistor or the like, when the basic reference voltage generator 7*a* is operated using this elevated voltage Vss2, there is the possibility that the effects of the switching noise in the Vss2 will be felt and the output voltage will be changed.

Another merit of providing Vss1 as the power source of the basic reference voltage generator 7*a* is that the basic reference voltage Vr is generated by allowing a constant current Ir to flow through the resistor R0 by means of the constant-current circuit 73 that is contained in the aforementioned basic reference voltage generator 7*a*; at this time, however, the power Pr consumed by the constant-current circuit 73 is expressed by Formula 2. Since the cell voltage Vss1 is one-half of the elevated voltage Vss2, the power Pr consumed is half of that when operation is effected using the −3.0 V elevated voltage Vss2, and this makes it possible to extend the life of the cell.

$$Pr = Ir \times Vss1 \tag{2}$$

Specifically, the stable power source voltage generator 7*d* of the constant-voltage generator 71 must output −2.6 V which is higher voltage than the cell voltage Vss1 and generates a stable power source voltage Vm with the elevated voltage Vss2 as the power source. On the other hand, the measurement reference voltage generator 7*c* and the sensor reference voltage generator, 7*b* of the constant-voltage generator 71 both of which output a voltage lower than Vss1, takes as their power source the cell voltage Vss1 for the same reasons as have been given for the basic reference voltage generator 7*a*, and output a sensor reference voltage Vs and a measurement reference voltage Vc, respectively.

As shown in FIG. 6, the sensor drive circuit 2 takes as its power source the cell voltage Vss1, and drives the air pressure sensor 1, on the basis of the sensor reference voltage Vs from the constant-voltage power source circuit 7. The power Ps consumed by the sensor drive circuit 2 is consequently expressed by Formula 3. Here, since the cell voltage Vss1 is a half of the elevated voltage Vss2, the power Ps consumed is half that operated using −3.0 V elevated voltage Vss2, and this also makes it possible to extend the life of the cell. Since the output of the air pressure sensor 1 is determined by the constant current Is from the sensor drive circuit 2, the voltage level of the air pressure signal S1 does not change even when the power source voltage is changed from Vss2 to Vss1, as long as the constant current Is is set to be the same.

$$Ps = Is \times Vss1 \tag{3}$$

As shown in FIG. 1, the air pressure signal S1 is amplified by the amplifier circuit 3 in the same manner as in the past to produce a signal S1' and this amplified signal S1' is converted by the A/D converter circuit 4 into digital data Dc. The data Dc is converted into sensor information data Dj by the sensor information data processor circuit 5 whose power source is the power source voltage Vss1, and the display unit 6 then displays the air pressure value based on this sensor information data Dj.

As is clear from the above explanation, the present invention makes it possible to carry out sensor signal processing through the use of a single −1.5 V button-type silver cell, without sacrificing conventional performance, by providing a step-up power source circuit, and by suitably combining this elevated voltage with the cell voltage and supplying these voltages to each circuit, and is consequently extremely effective in reducing costs and increasing the level of design freedom.

The present invention also makes it possible to reduce the power consumption by operating the sensor drive circuit at −1.5 V , and also makes it possible to reduce the power consumption by operating the basic reference voltage generator at −1.5 V. The effects of the switching noise of the elevated voltage can thus be avoided.

Industrial Applicability

The present invention is applicable to dive computers, altimeters, depth gauges, sensor function-equipped electronic clocks, and the like. Examples of sensor functions include functions of all types of sensors for detecting constantly changing physical information, such as air pressure, water pressure, and temperature.

What is claimed is:

1. A sensor function-equipped portable device comprising:

a sensor for detecting physical information;

a sensor drive circuit for driving said sensor;

an amplifier circuit for amplifying the sensor signal from said sensor;

an A/D converter circuit for converting the output signal of said amplifier circuit into digital information;

a sensor data processor circuit for preparing sensor information data from the digital information output from said A/D converter circuit; and a display unit for displaying physical values based on the sensor information data from said sensor data processor circuit, a cell as a low-voltage power source;

a step-up power source circuit for elevating the low voltage of said cell to a high voltage; and a constant-voltage power source circuit for stabilizing the high voltage elevated by said step-up power source circuit, said constant-voltage power source circuit being comprised of a constant-voltage generator and a basic reference voltage generator for generating a basic reference voltage, wherein said basic reference voltage generator is electrically supplied with the low voltage of said cell; and wherein said sensor drive circuit is directly driven by the low voltage of said cell, and wherein said amplifier circuit and said A/D converter circuit are driven by the high voltage stabilized by said constant-voltage power source circuit.

2. A sensor function-equipped portable device according to claim 1, wherein said constant-voltage generator is comprised of a stable power source voltage generator for generating a stable power source voltage and an operating reference voltage generator for generating an operating reference voltage, said operating reference voltage generator is elecrically supplied with the low voltage of said cell, and said stable power source voltage generator is electrically supplied with the high voltage elevated by said step-up power source circuit.

3. A sensor function-equipped portable device according to claim 2, wherein the operating reference voltage generated by said operating reference voltage generator is a voltage lower than the low voltage of said cell, and the stable power source voltage generated by said stable power source voltage generator is a voltage higher than the low voltage of said cell.

4. A sensor function-equipped portable device according to claim 3, wherein said operating reference voltage is comprised of a sensor reference voltage and a measurement reference voltage, and said operating reference voltage generator is comprised of a measurement reference voltage generator for generating said measurement reference voltage and a sensor reference voltage generator for generating said sensor reference voltage.

5. A sensor function-equipped portable device according to claim 4, wherein said measurement reference voltage is a voltage higher than said sensor reference voltage.

6. A sensor function-equipped portable device according to claim 5, wherein said sensor drive circuit is driven by said sensor reference voltage and by the low voltage of said cell, and said amplifier circuit and said A/D converter circuit are driven by said measurement reference voltage and said stable power source voltage.

7. A sensor function-equipped portable device according to claim 1, wherein said cell is a 1.5 V type cell.

8. A sensor function-equipped portable device according to claim 7, wherein the high voltage elevated by said step-up power source circuit is a voltage of integral times as high as the low voltage of said cell.

9. A sensor function-equipped portable device according to claim 8, wherein the high voltage elevated by said step-up power source circuit is a voltage that is twice as high as the low voltage of said cell.

10. A sensor function-equipped portable device according to claim 1, wherein said cell is a 1.5 V type cell, the high voltage elevated by said step-up power source circuit is a voltage of twice as high as the low voltage of said cell, and said stable power source voltage is in a range of 2.5 to 2.7 V.

11. A sensor function-equipped portable device according to claim 1, wherein said sensor function-equipped portable device is a sensor function-equipped electronic clock.

12. A sensor function-equipped portable device according to claim 11, wherein said cell also serves as the power source for the timepiece section of the sensor function-equipped electronic timepiece.

13. In a portable sensing device having a sensor for sensing a physical parameter and a battery for supplying a battery voltage, said device comprising a step-up circuit for generating an elevated voltage, said elevated voltage being greater than said battery voltage, an amplifier circuit for amplifying a signal generated by said sensor, an A/D converter for converting the amplified signal into digital data, and a power circuit for generating a source voltage and a reference voltage from said elevated voltage, said source voltage being greater than said battery voltage, said amplifier having said source voltage as its supply voltage, said reference voltage also being supplied to said amplifier, and said source voltage and said reference voltage also being applied to said A/D converter.

14. The device of claim 13 further comprising a drive circuit for driving said sensor, said drive circuit having a supply voltage no greater than said battery voltage.

15. The device of claim 14 wherein said battery voltage is utilized as the supply voltage for said drive circuit.

16. The device of claim 14 wherein said power circuit generates two reference voltages from said battery voltage, one of said reference voltages being applied to said drive circuit and the other of said reference voltages being applied to said amplifier circuit.

17. The devices of claim 16 wherein said battery voltage is greater than both of said reference voltages.

* * * * *